United States Patent [19]

Ogoshi et al.

[11] 4,129,511

[45] Dec. 12, 1978

[54] METHOD OF SPRAY DRYING DETERGENTS CONTAINING ALUMINOSILICATES

[75] Inventors: Toshiaki Ogoshi, Funabashi; Masayoshi Nakamura, Koshigaya; Izumi Yamane, Yokohma, all of Japan

[73] Assignee: The Lion Fat & Oil Co., Ltd., Tokyo, Japan

[21] Appl. No.: 834,302

[22] Filed: Sep. 19, 1977

[30] Foreign Application Priority Data

| | | | |
|---|---|---|---|
| Sep. 24, 1976 | [JP] | Japan | 51/114459 |
| Oct. 22, 1976 | [JP] | Japan | 51/126277 |
| Nov. 5, 1976 | [JP] | Japan | 51/132332 |

[51] Int. Cl.[2] ..... C11D 3/12; C11D 11/02

[52] U.S. Cl. ..... 252/140; 252/135; 252/385

[58] Field of Search ..... 252/140, 135, 131, 179, 252/385; 159/4 R, 4 CC, 4 VM, 4 MS

[56] References Cited

U.S. PATENT DOCUMENTS

| | | | |
|---|---|---|---|
| 3,629,951 | 12/1971 | Davis et al. | 159/4 CC X |
| 4,000,094 | 12/1976 | Fleming et al. | 252/131 X |
| 4,019,999 | 4/1977 | Ohren et al. | 252/140 |

FOREIGN PATENT DOCUMENTS 1371101 10/1974 United Kingdom.

*Primary Examiner*—Harris A. Pitlick

*Attorney, Agent, or Firm*—Blanchard, Flynn, Thiel, Boutell & Tanis

[57] ABSTRACT

A method of manufacturing granular detergents containing 15–40% of surface active agent, 5–20% of sodium silicate and 0.5–5% of aluminosilicate on a dry weight basis, which comprises subjecting a detergent slurry and an aluminosilicate slurry to spray-drying separately within the same drying space. The granular detergent thus manufactured possesses improved fluidity as well as reduced degree of hygrocaking property and compression-caking property. Incorporation in the aluminosilicate slurry with a small amount of an inflating agent will provide a granular detergent which is further improved in fluidity, hygrocaking property and compression-caking property.

6 Claims, No Drawings

METHOD OF SPRAY DRYING DETERGENTS CONTAINING ALUMINOSILICATES

BACKGROUND OF THE INVENTION

The present invention relates to a method of manufacturing granular detergents possessing improved fluidity, hygrocaking property and compression caking property wherein a detergent slurry and an aluminosilicate slurry are subjected separately to spray-drying within the same drying space.

As is generally known, not only are phosphate superior as builders for granular detergents, but also they play an important role in maintaining satisfactory powder properties, such as fluidity, hygrocaking property and compression-caking property, of granular detergents.

However, now that a problem has arisen in eutrophication of rivers and lakes caused by phosphates, there is a great demand for granular detergents having a low phosphate content. Accordingly, the powder properties of granular detergents show a tendency to considerable deterioration. This is due to the reason that, even though the deterioration of detergency caused by reducing the amount of a phosphate-type builder mixed therein may be somewhat made up for by the use of an alkali salt of silicic acid, carbonic acid or bicarbonic acid and by increasing the amount of the surface active agent, such alkali salt does not contribute very much to an improvement in the powder properties of granular detergents, as compared with phosphates.

As a means for improving the powder properties of granular detergents, the art of applying a certain coating onto the surface of particles of granular detergents is disclosed in U.S. Pat. Nos. 3,925,226, 3,950,275 and 3,989,635. The art disclosed in U.S. Pat. No. 3,925,226 is a method comprising wetting the surfaces of particles of granular detergents with a lower alcohol or a solution of a perfume, adding a metallic soap powder to the wet particles and coating the surface of the particles with a metallic soap powder by utilizing the adhesive power of the lower alcohol or the solution of perfume. The art disclosed in U.S. Pat. No. 3,950,275 is a method comprising wetting the surfaces of particles of granular detergents with water or an aqueous solution of a specific binder and attaching a specific powdery builder to the wet surface of the particles. The art disclosed in U.S. Pat. No. 3,989,635 is a method comprising spraying two kinds of aqueous solutions containing specific compounds, respectively, onto particles of granular detergents and allowing the compounds contained in these two kinds of aqueous solutions to react with each other thereby forming a water-insoluble film on the surfaces of the particles.

The foregoing methods are all intended to improve the powder properties by initially manufacturing a granular detergent by a spray-drying method and then applying an after-treatment to the granular detergent. Therefore, the finally obtained granular detergent is admittedly provided with satisfactory powder properties, but the granular detergent obtained only spray-drying is not provided with satisfactory powder properties. It is of course desirable that a granular detergent in the form of the final product should be provided with satisfactory powder properties, but it is more desirable that it should already be provided with satisfactory powder properties when it is discharged from the spray-drying tower.

There has recently been advocated the use of an aluminosilicate, which is insoluble in water but is capable of blocking calcium ions, as a builder for granular detergents. West German OLS No. 2,529,685 teaches a method of manufacturing granular detergents containing an aluminosilicate by subjecting a detergent slurry to spray-drying within a zone where particles of the aluminosilicate are dispersed. However, this method has a drawback that inasmuch as a relatively large quantity of aluminosilicate particles is directly introduced into the spray-drying tower, the amount of the aluminosilicate particles entrained in the drying air-stream discharged out of the drying tower is great.

The present inventors have found that fine aluminosilicate particles are very effective for improving the powder properties of granular detergents. They have also found that, when an aqueous slurry of fine aluminosilicate particles is subjected to spray-drying, the resulting dry granules are respectively agglomerates of several aluminosilicate particles, but these agglomerates are easily broken down into the individual fine particles in the original state even by weak shocks.

BRIEF SUMMARY OF THE INVENTION

According to the present invention, a detergent slurry and a particulate aluminosilicate slurry are separately prepared, and the two slurries are together subjected to spray-drying within a drying space. The detergent slurry contains 15–40% of a surface active agent and 5–20% of a sodium silicate on a dry weight basis and is prepared to have a water content of 35–45 wt.%. The particulate aluminosilicate slurry is prepared by employing an aluminosilicate having a mean particle diameter of 5$\mu$ or less so as to have a water content of 55–80 wt.%. The detergent slurry is sprayed into a lower temperature region of the drying space while the aluminosilicate slurry is sprayed into a higher temperature region of the drying space. The amount of the aluminosilicate slurry sprayed in is sufficient for obtaining a dry granular detergent containing 0.5–5 wt.% of the aluminosilicate. The aluminosilicate slurry may contain an inflating agent in an amount of at least 2 wt.% based on the aluminosilicate. The use of this inflating agent contributes to a further improvement in the powder properties of the granular detergent produced by spray-drying.

DETAILED DESCRIPTION OF THE INVENTION

In the method of the present invention, there is generally utilized a spray-drying system provided with a drying space wherein a drying gas stream ascends. According to this system, the detergent slurry is sprayed, usually downwardly, at a single or plural spraying stages disposed in the upper region of the drying space while the aluminosilicate slurry is sprayed upwardly or downwardly, preferably upwardly, at a single spraying stage disposed in the lower region of the drying space. When the detergent slurry has been subjected to spray-drying and the water content of the sprayed droplets has decreased to about 25% or less, the surface of the droplets is in an almost dry state. On the contrary, when the aluminosilicate slurry has been subjected to spray-drying and the water content of the sprayed droplets has decreased to about 40% or less, the surface of the droplets is substantially in the dry state. If the droplets of the detergent slurry come in contact with those of the aluminosilicate slurry while the surfaces of the droplets of either one of the two slurries is still an undried state, there is a fear that the particles of the aluminosilicate may adhere in the state of agglomerates formed by spraying onto the surfaces of the granular detergent.

Therefore, it is desirable that the spraying stage for the aluminosilicate slurry be disposed in the lower region, i.e., the higher temperature region, of the drying space and that the spraying stage for the detergent slurry be disposed above the spraying stage of the aluminosilicate slurry and near thereto at such a distance as to meet either one of the following requirements:

(A) the droplets of the detergent slurry should encounter those of the aluminosilicate slurry after the former droplets have been dried to have a water content of not greater than about 25 wt.%, and (B) the droplets of the aluminosilicate slurry should encounter those of the detergent slurry after the former droplets have been dried to have a water content of not greater than about 40 wt.%.

Examples of the aluminosilicate particles useful in the present invention include fine particles of all aluminosilicates exemplified by bentonite, montmorillonites, smectites, zeolite, kaolinite, etc. These aluminosilicate particles should have a mean particle diameter of about 5μ or less and preferably are substantially devoid of larger particles having a particle diameter of at least 10μ. The aluminosilicate slurry is prepared by dispersing the foregoing fine particles in water whereby the water content of the slurry is adjusted within the range of 55–80 wt.%.

As has been described above, when the aluminosilicate slurry is subjected to spray-drying, the fine aluminosilicate particles are dried in the form of agglomerates consisting of plural particles. These agglomerates are readily broken down into the individual particles of the original state even by very weak shocks. When a compound capable of decomposing at the drying temperature of the slurry, i.e., an inflating agent, is admixed with the aluminosilicate slurry prior to spray-drying, the agglomerates will become more apt to be broken down. When an aluminosilicate slurry containing an inflating agent is subjected to spray-drying, the inflating agent is pyrolyzed within the droplets in the course of drying and, accordingly, the droplets are dried in an inflated state or in the state of having a high percentage of voids. The inflating agent used in the present invention is required to be one which will be pyrolyzed preferably at a temperature below 100° C., that is, while the droplets still hold moisture, and will ensure that the pyrolyzed product will not act as binder. Examples of the inflating agent of this type include bicarbonates such as sodium bicarbonate, potassium bicarbonate, etc., ammonium salts such as ammonium carbonate, ammonium phosphate, ammonium sulfate, etc., and hypochlorites such as sodium hypochlorite, etc.

The amount of the inflating agent employed is at least 2 wt.% based on the aluminosilicate contained in the aluminosilicate slurry. If the amount is less than 2 wt.%, the spray-dried agglomerates of the aluminosilicate particles cannot be provided with sufficient voids. The upper limit of the amount of the inflating agent can optionally be determined within such a range that the droplets do not burst in the course of drying due to pyrolysis of the inflating agent, that the inflating agent or pyrolyzed products thereof do not function as a binder, and that the pyrolyzed products do not cause deterioration of the powder properties of the granular detergents. Generally speaking, the upper limit of the amount of the inflating agent employed is not greater than 15 wt.%, preferably not greater than 10 wt.%, and more preferably not greater than 8 wt.%, based on the alumino-silicate.

According to the present invention, the aluminosilicate slurry is sprayed, regardless of whether it contains the inflating agent or not, into the drying space in such an amount, in proportion to the amount of the detergent slurry, that a granular detergent containing 0.5–5 wt.% of the aluminosilicate is obtained. In case the amount of the aluminosilicate slurry sprayed is less than the foregoing amount, the powder properties of the resulting granular detergent cannot be improved as expected. On the other hand, in case the amount is more than the foregoing amount, not only are the powder properties of the resulting granular detergent rather deteriorated, but also dust is generated.

The detergent slurry for use in the present invention contains 15–40% of a surface active agent and 5–20% of sodium silicate based on the weight of the granular detergent obtained by the spray-drying. The surface active agent used in this case is chiefly an anionic surface active agent as in the case of conventional methods. Illustrative anionic surface active agents are, for example, (a) alkylbenzenesulfonates with an alkyl radical having 8–15 carbon atoms, (b) alkyl sulfates with an alkyl radical having 8–18 carbon atoms, (c) alkyl ether sulfates with alkyl radicals having 8–18 carbon atoms and ethylene oxide added thereto to the extent of 1–8 moles on the average, (d) α-olefinsulfonates obtained from an α-olefin having 12–22 carbon atoms (which may contain an alkenesulfonate and a hydroxyalkanesulfonate), (e) alkanesulfonates obtained from a paraffin having 12–22 carbon atoms, (f) salts of higher fatty acids, (g) salts of a condensate of a higher fatty acid and taurine (N-acylaminoethanesulfonates), (h) salts of a sulfosuccinic acid dialkyl ester, etc. All of these anionic surface active agents are usually employed in the form of alkali metal salts thereof, but the sulfonates or sulfates may also be employed in the form of magnesium salts thereof.

In the present invention, a non-ionic surface active agent or an amphoteric surface active agent may also be used either independently or jointly with the anionic surface active agent. Illustrative non-ionic surface active agents are, for example, polyoxyethylene alkyl ethers, polyoxyethylene alkylphenyl ethers, polyoxyethylene fatty acid esters, sorbitan fatty acid ester polyoxyethylene ethers, sucrose fatty acid esters, fatty acid alkylolamides, etc. Illustrative amphoteric surface active agents are, for example, betaines, e.g., lauryl dimethyl carboxymethyl ammonium betaine, etc., alanines and imidazalines.

The sodium silicate for use in preparing the detergent slurry of the present invention is expressed by the empirical formula: $Na_2O{\cdot}XSiO_2$ (wherein $X=2.0$–$3.6$). This sodium silicate functions as a builder component of the granular detergent. At the time of preparing the detergent slurry of the present invention, the detergent slurry may optionally contain, in addition to the sodium silicate, some other inorganic builders and/or organic builders as will be described hereinafter or some additives for detergents which are useful for the conventional granular detergents. Examples of the useful inorganic builders include phosphate-type builders such as tripolyphosphates, pyrophosphates, orthophosphates, etc. and carbonates, sulfates, etc. Examples of the useful organic builders include citrates, malates, tartrates, maleic acid polymers, alkyl-substituted succinates, oxydiacetates, etc.

All of these builders are desirably used in the form of alkali metal salts thereof. When a phosphate-type builder is used, the amount thereof is desirably not greater than 15% based on the dry weight of the granular detergent.

Examples of the additives for detergents which can be incorporated into the detergent slurry of the present invention include soil redeposition-preventing agents (e.q., CMC, PEG, PVA, PVP, etc.), fluorescent optical brightening agents, foam-controlling agents, antibiotic substances, dyes, etc.

The detergent slurry of the present invention is prepared so that the water content thereof may be within the range of 35–45 wt.%. Further, the granular detergent of the present invention may contain a bicarbonate as a builder component thereof and a bleaching agent (such as a percarbonate), a perfume, etc. as additives to the detergent.

When a bicarbonate is incorporated into the detergent slurry, however, there is a fear that the bicarbonate may react with an alkali and permit evolution of carbon dioxide. In the case of using a bicarbonate, therefore, it is desirable to admix it with the granular detergent after spray-drying. As the bleaching agent, perfume, etc. are apt to be affected adversely by heat, these additives are generally incorporated into the granular detergent after spray-drying.

As has been described in the foregoing, the spray-drying treatment of the present invention is performed by utilizing a drying space wherein a drying gas flows upwardly. Typically, in this drying space, a drying gas having an inlet temperature of about 200°–450° C. and an outlet temperature of about 70°–150° C. flows at a speed of about 1.2 m/sec.

The present invention will be illustrated in more detail by way of examples. It is to be construed however that the scope of the present invention is not limited to the specific embodiments illustrated in these examples.

EXAMPLES 1

By introducing the detergent slurry from a stage 10 m above the drying gas inlet of a countercurrent spray-drying tower and introducing the aluminosilicate slurry from a stage 3 m below the foregoing stage, both slurries were subjected to spray drying. The temperature of the drying gas was adjusted to about 300° C. at the inlet and about 100° C. at the outlet. Subsequently, the resultant granular detergent was evaluated with respect to the powder properties, i.e., fludity (or angle of repose), compression-caking property and hygrocaking property. The methods of evaluation of the compression-caking property and the hygrocaking property were as follows:

Compression-caking property: The sample detergent granular particles were packed in a cylindrical receptacle of 10 cm in inside diameter and 15 cm in depth and thereafter a load of 5 kg was applied thereon to form a test piece. The compression-caking property was evaluated by measuring the load (kg) required to crush the test piece.

Hygrocaking property: The sample granular detergent particles were charged in a carton box (22 cm × 15.5 cm × 5.5 cm) and allowed to stand for 7 days in an 85% — humidity box at 35° C. and then the box was cut open, the detergent particles were sifted carefully onto a 4-mesh sieve and the sieve was oscillated gently. The hygrocaking property was evaluated by measuring the weight percentage of the detergent particles left on the sieve, based on the total quantity of detergent particles.

The composition of both slurries sprayed (on the basis of the weight of granular detergent) and the powder properties of the granular detergent are shown in Table 1.

Table 1

| | | 1 | 2 | 3 | 4 | 5 | 6 | 7 | 8 | 9 | 10 | 11 |
|---|---|---|---|---|---|---|---|---|---|---|---|---|
| Detergent slurry | Sodium alkylbenzene sulfonate | 10 | 10 | 10 | 10 | 20 | 10 | 10 | — | 10 | 20 | 10 |
| | Sodium α-olefin sulfonate | 10 | 10 | 10 | 10 | — | 10 | 10 | 10 | 10 | 5 | 10 |
| | Sodium alkyl sulfate | — | — | — | 5 | — | — | — | 10 | — | 13 | 5 |
| | Sodium alkyl ether sulfate ($\bar{p}$ = 3) | — | — | 5 | — | — | — | — | 10 | 10 | 5 | — |
| | Sodium silicate | 10 | 10 | 10 | 10 | 10 | 10 | 10 | 15 | 15 | 10 | 10 |
| | Sodium tripolyphosphate | 10 | 10 | 01 | — | 10 | 10 | 01 | — | — | — | 10 |
| | Sodium pyrophosphate | — | — | — | 10 | — | — | — | — | — | 10 | — |
| | Sodium carbonate | 5 | 5 | 5 | — | 5 | 5 | 5 | 30 | 30 | 10 | 10 |
| | Water content of slurry (%) | 40 | 40 | 42 | 42 | 38 | 40 | 40 | 40 | 40 | 40 | |
| Alumino-silicate slurry | Synthetic zeolite (mean particle diameter:0.7μ) | — | 0.5 | 1 | 2 | 3 | 4 | 8 | 1 | 1.5 | 2 | — |
| | Kaolin (mean particle diameter: less than 1μ) | — | — | — | — | — | — | — | — | — | — | 2 |
| | Water content of slurry (%) | — | 60 | 70 | 60 | 65 | 60 | 60 | 60 | 75 | 60 | 60 |
| | Angle of repose (fluidity) (degree) | 70 | 45 −50 | 40 −45 | 40 −45 | 45 | 45 | 60 | 40 −45 | 40 −45 | 45 | 45 |
| Powder properties | Compression-caking property (kg) | 5.0 | 2.5 | 2.3 | 2.2 | 2.2 | 2.5 | 2.0 | 2.5 | 2.5 | 2.5 | 2.2 |
| | Hygrocaking property (%) | 80 | 15 | 10 | 10 | 10 | 20 | 25 | 20 | 20 | 20 | 20 |

Remarks:
The dry granular detergent contains about 8% of water and a small amount of conventional ingredients. Besides, it contains sodium sulfate making up the balance.

EXAMPLE 2

In order to manufacture a granular detergent having a composition as shown in Table 2, a detergent slurry composed of the ingredients exclusive of synthetic zeolite and having a water content of about 40 wt.% and a synthetic zeolite slurry having a water content of about 70 wt.% were prepared separately.

Table 2

| Ingredients | (wt. %) A | B | C |
|---|---|---|---|
| Sodium α-olefin sulfonate having 14–18 carbon atoms) | 10 | 10 | 10 |
| Sodium linear alkylbenzene sulfonate | 15 | — | 15 |
| Sodium alkyl ether sulfate (having 11–15 carbon atoms; $\bar{P}$ = 3) | — | 10 | 5 |
| Sodium alkyl sulfate | — | 10 | — |

Table 2-continued

| Ingredients | A | B | C |
|---|---|---|---|
| | (wt. %) | | |
| (having 12–15 carbon atoms) | | | |
| Sodium silicate ($Na_2O.25SiO_2$) | 12 | 15 | 15 |
| Sodium tripolyphosphate | 15 | — | — |
| Sodium pyrophosphate | — | — | 10 |
| Sodium carbonate | — | 25 | 10 |
| Sodium sulfate | 33 | 17 | 23 |
| The others | 3 | 3 | 3 |
| Synthetic zeolite (having a mean particle diameter of 0.7μ) | 3 | 2 | 1 |
| Water | 9 | 8 | 8 |
| Total | 100 | 100 | 100 |

By employing a spray-drying tower wherein the drying gas flows upwardly, the detergent slurry was sprayed downwardly from the spraying stage at such a distance as shown in Table 3 from the lower end of the drying gas inlet, while spraying the synthetic zeolite slurry upwardly or downwardly, and the granular detergents were prepared. Thus obtained granular detergents were evaluated by the same method as described in Example 1. The results are shown in Table 3. When the synthetic zeolite slurry was sprayed upwardly, it reached a highest position of about 1 m above the spraying stage therefor, but the water content of the droplets of zeolite slurry in the position was about 50 wt.%.

Table 3

| | 1 | 2 | 3 | 4 | 5 | 6 | 7 | 8 | 9 | 10 |
|---|---|---|---|---|---|---|---|---|---|---|
| Detergent slurry spraying stage (m) | 10 | 10 | 10 | 10 | 10 | 10 | 10 | 10 | 10 | 10 |
| Synthetic zeolite spraying stage (m) | — 0 | — 2 | — 5 | — 5 (downwardly) | 5 0 | 5 1 | 5 2 | 5 2 (downwardly) | — 0 | — 0 |
| Inlet temperature of hot blast (° C) | 350 | 350 | 350 | 350 | 340 | 340 | 340 | 340 | 300 | 400 |
| Outlet temperature of hot blast (° C) | 90 | 90 | 90 | 90 | 85 | 85 | 86 | 88 | 100 | 90 |
| Water content of detergent particles 1 m above the synthetic zeolite spraying stage (wt. %) | 12 | 18 | 30 | (30) | 15 | 20 | 32 | (32) | 12 | 12 |
| Powder properties: Angle of repose (degree) | 40 | 40 | 45–50 | 45 | 40 | 40 | 45–50 | 50–55 | 40 | 40 |
| Compression-caking, property (kg) | 1.5 | 1.7 | 2.5 | 2.2 | 1.5 | 1.5 | 2.5 | 3.0 | 1.7 | 1.4 |
| Hygrocaking property (kg) (amount of aggregate; %) | | | | | | | | | | |
| after 7 days | 5 | 5 | 20 | 15 | 5 | 5 | 25 | 40 | 10 | 10 |
| after 20 days | 20 | 20 | 90 | 80 | 15 | 20 | 80 | 95 | — | — |
| Type of composition of granular detergent | A | A | A | A | A | A | A | A | B | C |

Remarks: Nos. 3, 4, 7 and 8 are comparative examples.

REFERENCE EXAMPLE

To synthetic zeolite consisting of particles having a mean diameter of 0.7μ employed as aluminosilicate particles, were added a given amount of a inflating agent shown in Table 4 per 100 parts by weight of said synthetic zeolite and water. Thus slurries having a water content of about 70 wt.% were prepared. Subsequently, the slurries were subjected to spray-drying by a spray-drying apparatus wherein the inlet temperature of the drying air had been set at 200° C. and the outlet temperature of the same at about 100° C., the bulk specific gravity of the obtained dry granular particles and the easiness to break down thereof were measured. The results of the measurements are shown in Table 4.

Table 4

| Inflating agent | Amount of inflating agent added to (part by weight) | Bulk specific gravity | Easiness to* break down |
|---|---|---|---|
| None | 0 | 0.48 | ○ |

Table 4-continued

| Inflating agent | Amount of inflating agent added to (part by weight) | Bulk specific gravity | Easiness to* break down |
|---|---|---|---|
| Sodium bicarbonate | 1 | 0.46 | ○ |
| Sodium bicarbonate | 5 | 0.40 | ◎ |
| Sodium hypochlorite | 3 | 0.38 | ◎ |

Remarks
*Judgement by tactile impression
○ 'Satisfactory'
◎ 'Especially satisfactory'

EXAMPLE 3

A detergent slurry comprising the ingredients shown in Table 5 and having a water content of about 40 wt.% and an alumino-silicate slurry comprising the ingredients shown in Table 5 and having a water content of about 70 wt.%, were prepared respectively Subsequently by subjecting both slurries to spray-drying according to the method of the present invention, a granular detergent was manufactured. The conditions for spray-drying and the powder properties of the resultant granular detergent were as shown in Table 6. In Table 6, the spraying stage for the each slurry is expressed by the distance from the lower end of the inlet for the hot drying air in the spray-drying apparatus, and the powder properties shown therein are the results of evaluation conducted in the same manner as described in Example 1.

Table 5

| | Ingredients | A(%)* | B(%)* | C(%)* |
|---|---|---|---|---|
| I | Sodium linear alkylbenzene sulfonate | 15 | — | — |
| | Sodium α-olefin sulfonate (having 14–18 carbon atoms) | 10 | 10 | 15 |
| | Sodium alkyl sulfate (having 11–15 carbon atoms) | — | 10 | 10 |
| | Sodium alkyl ether sulfate (having 11–15 carbon atoms; $\bar{P} = 3$) | — | 10 | 5 |
| | Sodium silicate | 12 | 15 | 10 |
| | Sodium tripolyphosphate | 15 | — | — |
| | Sodium pyrophosphate | — | — | 15 |
| | Sodium carbonate | — | 25 | — |
| | Sodium sulfate | 33 | 17 | 32 |
| | A modicum of additive | 3 | 3 | 3 |
| II | Synthetic zeolite (mean particle diameter: 0.7μ) | 3 | 2 | 2 |
| | Inflating agent | Described in Table 6 | | |
| | Water content | 9 | 8 | 8 |

Table 5-continued

| Ingredients | | A(%)* | B(%)* | C(%)* |
|---|---|---|---|---|
| | Total | 100 | 100 | 100 |

Remarks
*On the basis of weight of the dry granular detergent.

Table 6

| Experiment No. | | 1 | 2 | 3 | 4 | 5 | 6 |
|---|---|---|---|---|---|---|---|
| Type of composition of granular detergent | | A | A | A | A | B | C |
| Inflating agent: kind | | $NaHCO_3$ | $NaHCO_3$ | NaClO | $(NH_4)_3PO_4$ | $NaHCO_3$ and NaClO | NaClO |
| amount (wt. % relative to synthetic zeolite) | | 1 | 3 | 5 | 4 | 3 each (6 in total) | 2 |
| Detergent slurry spraying stage (m) | | 10 | 10 | 10 | 10 | 10 | 10 |
| Aluminosilicate slurry spraying (m) stage | | 5 | 5 | 5 | 5 | 5 | 5 |
| and direction of spraying | | downwardly | downwardly | downwardly | downwardly | downwardly | upwardly |
| Inlet temperature of hot blast (° C) | | 350 | 350 | 350 | 350 | 300 | 340 |
| Outlet temperature of hot blast (° C) | | 90 | 90 | 90 | 90 | 100 | 85 |
| Powder properties | Angle of repose (degree) | 45 | 40 | 35–40 | 35–40 | 40 | 35–40 |
| | Compression-caking property (kg) | 2.2 | 1.5 | 1.4 | 1.4 | 1.5 | 1.5 |
| | Hygrocaking property (amount of aggregate; wt.%) after 7 days | 15 | 10 | 10 | 10 | 10 | 10 |
| | after 20 days | 80 | 40 | 30 | 35 | 40 | 20 |

Remarks
Experiment No. 1 is a comparative example.

As is evident from the above elucidation, according to the method of the present invention, granular detergents having satisfactory powder properties can be manufactured simply by spray drying without resorting to any particular after-treatment. Thus, according to the method of the present invention conventional various troubles ascribable to the poor fluidity of detergent particles, which are apt to take place in the vicinity of the bottom of the drying tower on the occasion of manufacturing granular detergents containing a low content of phosphate-type builder, can be overcome.

What is claimed is:

1. A method of manufacturing a granular detergent, which comprises:

(a) preparing an aqueous detergent slurry which contains 15–40% of organic synthetic surface active agent and 5–20% of sodium silicate based on the dry weight of said granular detergent, said detergent slurry having a water content of 35–45 wt.%;

(b) preparing an aqueous aluminosilicate slurry containing fine aluminosilicate particles having a mean particle diameter of not greater than about 5μ and which are substantially free of particles having a particle diameter of at least about 10μ, said aluminosilicate slurry having a water content of 55–80 wt.%;

(c) spraying said detergent slurry downwardly into the upper region of a drying space wherein a hot drying gas is flowing upwardly, at one or a plurality of spraying stages disposed in said upper region; and (d) simultaneously separately spraying said aluminosilicate slurry upwardly or downwardly into the lower region of said drying space, at a spraying stage disposed in said lower region, in an amount such that said granular detergent contains 0.5–5 wt.% of said aluminosilicate based on the dry weight of said granular detergent, the temperature of said drying gas being lower in said upper region than it is in said lower region.

2. A method according to claim 1, wherein the lowermost spraying stage at which said detergent slurry is sprayed into said drying space and said spraying stage at which said alumino-silicate slurry is sprayed into said drying space are vertically spaced-apart such a distance that at least one of the following requirements is met:

(a) the droplets of said detergent slurry first contact and mix with the droplets of said aluminosilicate slurry after the former droplets have been dried to have a water content of not greater than about 25 wt.%, and (b) the droplets of said aluminosilicate slurry first contact and mix with the droplets of said detergent slurry after the former droplets have been dried to have a water content of not greater than about 40 wt.%.

3. A method according to claim 1, wherein the direction of spraying said aluminosilicate slurry is upward.

4. A method according to claim 1, wherein said aluminosilicate slurry contains an inflating agent pyrolyzable at the drying temperature, the amount of said inflating agent being at least 2 wt.% based on the weight of said aluminosilicate, said inflating agent being at least one compound selected from the group consisting of sodium bicarbonate, potassium bicarbonate, ammonium carbonate, ammonium phosphate, ammonium sulfate and sodium hypochlorite.

5. A method according to claim 1, wherein the principal ingredient of said surface active agent in said detergent slurry is an anionic surface active agent.

6. A method according to claim 1, wherein the amount of phosphate-type builder contained in said detergent slurry is not greater than about 15 wt.% based on the dry weight of said granular detergent.

* * * * *